US007476029B2

(12) United States Patent
Miyake

(10) Patent No.: US 7,476,029 B2
(45) Date of Patent: Jan. 13, 2009

(54) BAG FOR CONTAINING AN ARTICLE

(75) Inventor: Hisahito Miyake, Osaka (JP)

(73) Assignee: A.G. Corporation, Tokyo (JP)

( * ) Notice: Subject to any disclaimer, the term of this patent is extended or adjusted under 35 U.S.C. 154(b) by 418 days.

(21) Appl. No.: 10/680,227

(22) Filed: Oct. 8, 2003

(65) Prior Publication Data

US 2005/0078889 A1 Apr. 14, 2005

(51) Int. Cl.

| | |
|---|---|
| ***B65D 30/16*** | (2006.01) |
| ***B65D 30/08*** | (2006.01) |
| ***B65D 33/02*** | (2006.01) |
| ***B65D 30/10*** | (2006.01) |

(52) U.S. Cl. ..... 383/104; 383/116; 383/119; 383/121

(58) Field of Classification Search ..... 383/104, 383/121, 116, 119

See application file for complete search history.

(56) References Cited

U.S. PATENT DOCUMENTS

| | | | | |
|---|---|---|---|---|
| 3,935,993 | A * | 2/1976 | Doyen et al. | 383/94 |
| 4,353,497 | A * | 10/1982 | Bustin | 383/104 |
| 4,718,738 | A * | 1/1988 | Bell | 383/121 |
| 5,134,875 | A * | 8/1992 | Jensen et al. | 73/1.03 |
| 5,384,233 | A * | 1/1995 | Kuse et al. | 430/461 |
| 6,341,895 | B1 * | 1/2002 | Tani | 383/116 |
| 6,478,190 | B2 * | 11/2002 | Kuge et al. | 222/107 |

FOREIGN PATENT DOCUMENTS

| | | | | |
|---|---|---|---|---|
| EP | 0 626 319 | A1 * | 11/1994 | 383/104 |
| JP | 2-4651 | * | 1/1990 | 383/104 |
| JP | 2002-332049 | A | 11/2002 | |

* cited by examiner

*Primary Examiner*—Jes F Pascua
(74) *Attorney, Agent, or Firm*—Birch, Stewart, Kolasch & Birch, LLP

(57) ABSTRACT

To provide a bag for containing an article that includes a gusset at a bottom portion thereof and in which a bottom sheet is difficult to tear and that has sufficient strength. A film that has excellent extensibility and tearing resistance in comparison to a front sheet and a rear sheet is used for a bottom sheet, whereby a bag for containing an article can be provided that has sufficiently great strength and in which the bottom sheet is difficult to tear in comparison to conventional bags for containing an article, even if the weight of an article disposed in an article containing space is applied.

4 Claims, 6 Drawing Sheets

BAG FOR CONTAINING AN ARTICLE

TECHNICAL FIELD

The present invention relates to a bag for containing an article including a gusset at a bottom portion thereof.

BACKGROUND ART

Conventionally, bags for containing an article, which are bag bodies where necessary places of resin sheets having flexibility are adhered together with a heat seal or the like to form an article containing portion enclosed by the sheets, have been widely used. Among these, there are bags for containing an article including a gusset at a bottom portion thereof.

Bags for containing an article including a gusset are bags where, at the bottom portion of a bag body configured from a flat front sheet and a flat rear sheet, a bottom sheet that is continuous with the aforementioned sheets or is a sheet that is different from the aforementioned sheets is disposed.

The bottom sheet is, for example, folded in two at the inner side of the bag body—i.e., at the article containing portion side—so that the cross-sectional shape of the bag for containing an article at the bottom portion is formed in a "Σ" shape by the front sheet, the rear sheet and the bottom sheet. By disposing the bottom sheet folded in this manner, the bag for containing an article is such that it has a flat form in a state where an article is not disposed in the article containing portion, and the bottom sheet is expanded and the internal volume of the bag for containing an article can be increased when an article is contained in the article containing portion.

However, when the bag for containing an article is swung or suddenly lifted up in a state where an article is disposed in the article containing portion, there have been cases where a force exceeding the strength of the sheets is suddenly concentrated, due to the weight of the article, at places of contact points where the front sheet, the rear sheet and the bottom sheet are respectively adhered together, whereby the bottom sheet ends up being torn.

In a case where the bag for containing an article is used as a deaerated bag that can be stored compact by compressing an article whose volume is large because it includes air, such as bedding or clothing, by deaerating air present in the article containing portion, the fact that tears of the bottom sheet in this manner have been a fatal problem because the bag for containing an article no longer fulfills the function of maintaining the deaerated state of the article containing portion.

SUMMARY AND OBJECTS OF THE INVENTION

In light of these circumstances, it is an object of the present invention to provide a bag for containing an article that includes a gusset at a bottom portion thereof and in which the bottom sheet is difficult to tear and that has sufficient strength.

In order to solve the above problems, a first aspect of the present invention application provides a bag for containing an article comprising a front sheet 11, a rear sheet 12 and a bottom sheet 13 disposed at a lower portion of the front sheet 11 and the rear sheet 12, which are resin sheets having flexibility, with an article containing portion 2 being formed between these sheets 11, 12, 13, wherein the front sheet 11 includes a bottom edge 11*d* positioned below and left and right side edges 11*b*, 11*c* that extend upward from both left and right ends of the bottom edge 11*d*, wherein the rear sheet 12 includes a bottom edge 12*d* positioned below and left and right side edges 12*b*, 12*c* that extend upward from both left and right ends of the bottom edge 12*d*, wherein the bottom sheet 13 includes a front bottom surface 13*x* and a rear bottom surface 13*y* that are partitioned across at least one folding line 13*a*, wherein the front bottom surface 13*x* includes the folding line 13*a*, a front bottom edge 13*f* positioned below the folding line 13*a*, and a left front side edge 13*b* and a right front side edge 13*d* that join both respective left and right ends of the folding line 13*a* and the front bottom edge 13*f*, wherein the rear bottom surface 13*y* includes the folding line 13*a*, a rear bottom edge 13*g* positioned below the folding line 13*a*, and a left rear side edge 13*c* and a right rear side edge 13*e* that join both respective left and right ends of the folding line 13*a* and the rear bottom edge 13*g*, wherein the folding line 13*a* is disposed between the front sheet 11 and the rear sheet 12, wherein the bottom edge 11*d* of the front sheet 11 and the front bottom edge 13*f* of the bottom sheet 13 are adhered together, wherein the bottom edge 12*d* of the rear sheet 12 and the rear bottom edge 13*g* of the bottom sheet 13 are adhered together, wherein the left and right side edges 11*b*, 11*c* of the front sheet 11 and the left and right side edges 12*b*, 12*c* of the rear sheet 12 are respectively adhered together above the folding line 13*a*, wherein a bag body 1 including therein the article containing portion 2 is formed by the bottom edge 11*d* of the front sheet 11 and the front bottom edge 13*f* of the bottom sheet 13 being adhered together and by the bottom edge 12*d* of the rear sheet 12 and the rear bottom edge 13*g* of the bottom sheet 13 being adhered together, and wherein the extensibility and tearing resistance of the bottom sheet 13 are higher than the extensibility and tearing resistance of the front sheet 11 and the rear sheet 12.

According to a second aspect of the present invention, the left front side edge 13*b* of the front bottom surface and the left rear side edge 13*c* of the rear bottom surface in the bottom sheet 13 are adhered together, and the right front side edge 13*d* of the front bottom surface and the right rear side edge 13*e* of the rear bottom surface are adhered together.

According to a third aspect of the present invention, the bottom sheet 13 includes a inextensible (non-extensible) nylon film.

According to a fourth aspect of the present invention, the bottom sheet 13 is a co-extrusion film where a inextensible (non-extensible) nylon film 13*n* and a low-density polyethylene film 13*pe* are laminated together, the low-density polyethylene film 13*pe* being disposed on at least one of a surface side and an undersurface side of the inextensible (non-extensible) nylon film 13*n*.

According to a fifth aspect of the present invention, the bottom sheet 13 has a tensile ductility of 400% to 800%.

EFFECTS OF THE INVENTION

During implementation of the invention of the present application, a film that has excellent extensibility and tearing resistance in comparison to the front sheet 11 and the rear sheet 12 is used for the bottom sheet 13, whereby a bag for containing an article that has sufficiently great strength and in which the bottom sheet 13 is difficult to tear in comparison to conventional bags for containing an article, even if the weight of an article M disposed in the article containing space 2 is applied, can be provided.

DETAILED DESCRIPTION OF THE PREFERRED EMBODIMENTS

Figure 1:
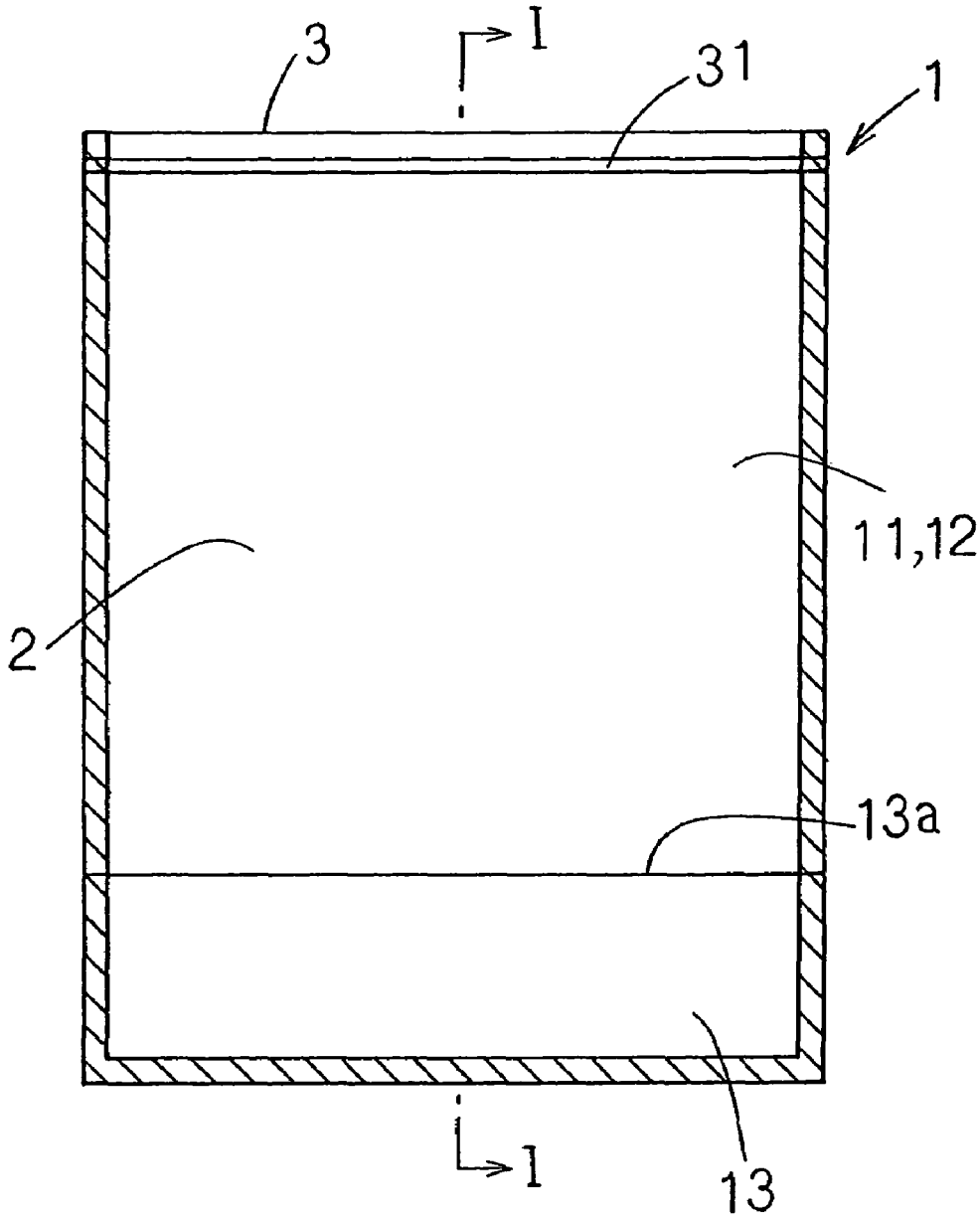
FIG. 1 A plan view showing a bag for containing an article pertaining to an example of an embodiment of the invention of the present application.
Figure 3:
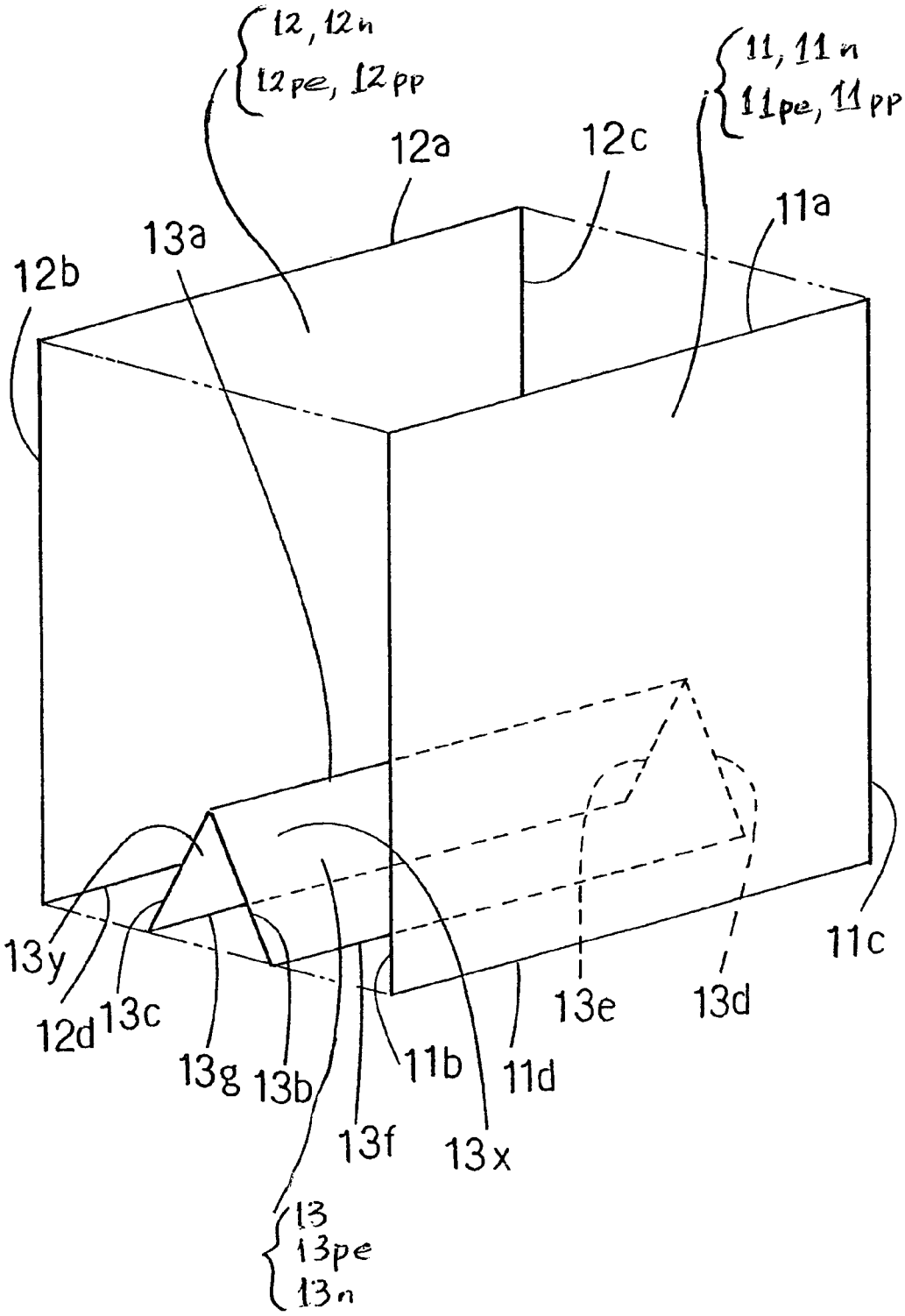
FIG. 3 An exploded perspective view showing the configuration of respective sheets in the bag for containing an article of the present example.

An example of an embodiment of the invention of the present application will be described below on the basis of the drawings. FIG. 1 is a plan view showing a bag for containing an article of the present example, and FIG. 3 is an explanatory diagram showing a use example of the bag for containing an article of the present example. It should be noted that expressions indicating direction in the description below refer to directions shown in FIG. 1.

A bag 1 for containing an article of the present example is a bag body that is rectangular when seen in plan view, as shown in FIG. 1. The bag 1 for containing an article is also one where a front sheet 11 and a rear sheet 12 of the same shape are adhered together with a heat seal.

Here, at a bottom portion of the bag 1 for containing an article, a bottom sheet 13, which is rectangular when seen in plan view, is disposed so as to be sandwiched between the front sheet 11 and the rear sheet 12, as shown in FIG. 3. Specifically, as shown in FIG. 3, the bottom sheet 13 of the present example includes a front bottom surface 13*x* and a rear bottom surface 13*y* that are partitioned via a folding line 13*a*. The front bottom surface 13*x* includes the folding line 13*a*, a front bottom edge 13*f* positioned below the folding line 13*a*, and a left front side edge 13*b* and a right front side edge 13*d* that join both respective left and right ends of the folding line 13*a* and the front bottom edge 13*f*. The rear bottom surface 13*y* includes the folding line 13*a*, a rear bottom edge 13*g* positioned below the folding line 13*a*, and a left rear side edge 13*c* and a right front side edge 13*d* that join both respective left and right ends of the folding line 13*a* and the rear bottom edge 13*g*. The bottom sheet 13 is one whose width dimension is formed so as to be equal with respect to the front sheet 11 and the rear sheet 12. In the present example, the bottom sheet 13 is disposed between the sheets 11 and 12 in a form where it is folded in two at the folding line 13*a*.

Here, because the front sheet, the rear sheet and the bottom sheet have comprised sheets of the same material in conventional bags for containing an article including a gusset at the bottom portion, the bag body has been formed by folding the bottom sheet into a "Σ" shape in section and adhering the left and right side surfaces. In contrast, as will be described in detail later, because the front and rear sheets 11, 12 and the bottom sheet 13 comprise sheets of a different material in the bag 1 for containing an article pertaining to the invention of the present application, the front sheet 11 and the bottom sheet 13, and the rear sheet 12 and the bottom sheet 13, are respectively adhered together.

Figure 6:
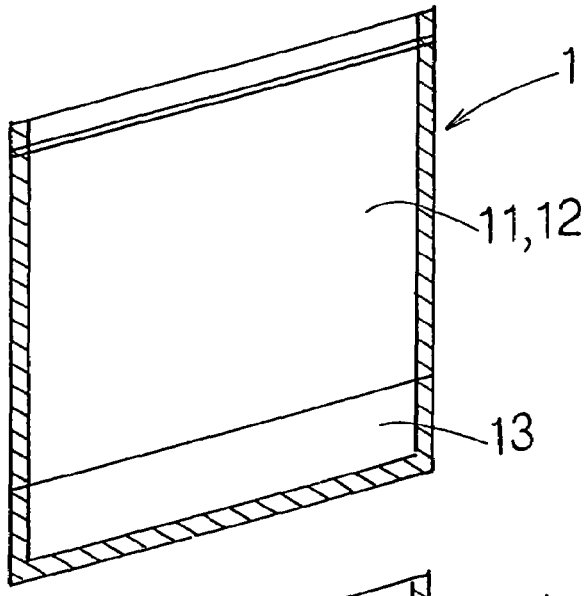
FIGS. 6(A) and (C) show bags for containing an article that have been made into flat forms, and (B) shows a bag for containing an article that has been made into a "Y" shape when seen in side view.
Figure 6:
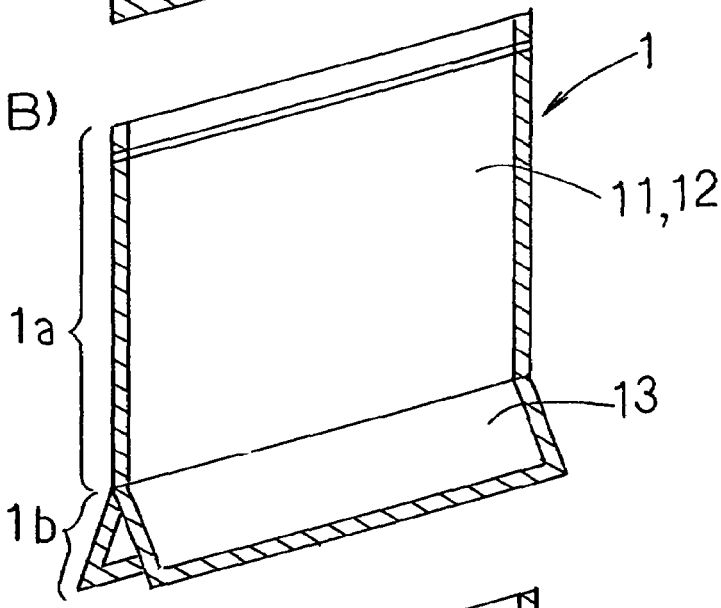
Figure 6:
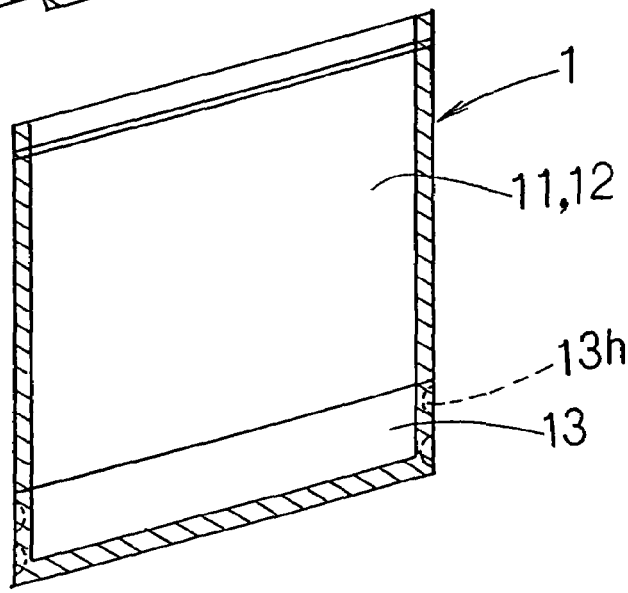

As specific examples, left and right side edges 11*b*, 11*c* of the front sheet 11 and the left and right front side edges 13*b*, 13*d* of the bottom sheet 13 and the left and right rear side edges 13*c*, 13*e* and left and right rear side edges 12*b*, 12*c* of the rear sheet 12 shown in FIG. 3 are adhered together to make a bag having a flat form as shown in FIG. 6(A). Also, as shown in FIG. 6(B), in a range 1*a* where the bottom sheet 13 is not present between the front sheet 11 and the rear sheet 12, the left and right side edges 11*b*, 11*c* of the front sheet 11 are adhered to the left and right side edges 12*b*, 12*c* of the rear sheet 12, and in a range 1*b* where the bottom sheet 13 is present, the left and right side edges 11*b*, 11*c* of the front sheet 11 are adhered to the left and right front side edges 13*b*, 13*d* of the bottom sheet 13 and the left and right side edges 12*b*, 12*c* of the bottom sheet 12 are adhered to the left and right rear side edges 13*c*, 13*e* of the bottom sheet 13 to make a bag having a "Y" shaped form when seen in side view.

Because the sheets 11, 12, 13 are adhered together in the manners described above, an article containing portion 2 is formed so as to be enclosed by the front sheet 11, the rear sheet 12 and the bottom sheet 13.

In a case where a laminate film comprising a low-density polyethylene film 13*n* and a inextensible nylon film 13*n* are used as the bottom sheet 13 and in which the inextensible nylon film 13*pe* projects toward the inner surface side in a state where it is folded in two, the bag cannot be formed in the flat form shown in FIG. 6(A) with a heat seal as it is because the nylon film 13*n* lacks heat salability. Thus, semicircular or V-shaped cutouts 13*h* are formed in the left front side edge 13*b*, the right front side edge 13*d*, the left rear side edge 13*c* and the right rear side edge 13*e* of the bottom sheet, whereby the bag can be made into the flat form shown in FIG. 6(C) by adhering together the front sheet 11 and the rear sheet 12, which have heat sealability, at the portions of the cutouts 13*a*. In this case, because the front bottom edge 13*f* and the rear bottom edge 13*g* of the bottom sheet 13 are not adhered together, in actuality, the bottom edge portion has a "Y" shaped form similar to that which is shown in FIG. 6(B).

Figure 2:
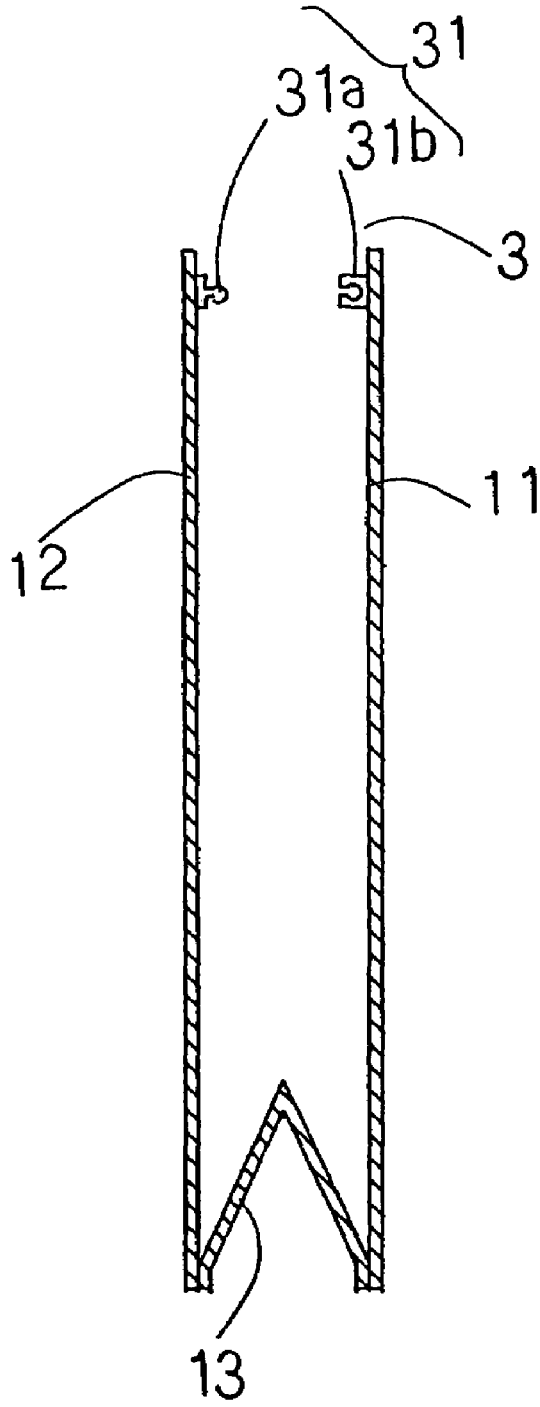
FIG. 2 An explanatory diagram seen from the I-I cross section of FIG. 1.

As for the upper edge of the bag 1 for containing an article, an upper edge 11*a* of the front sheet 11 and an upper edge 12*a* of the rear sheet 12 are not adhered together, but an open portion 3 is formed so that an article M can be placed in and taken from the article containing portion 2 via the open portion 3. A chuck 31 comprising a convex portion 31*a* and a concave portion 31*b* as shown, for example, in FIG. 2, is attached to the inner surface of the open portion 3 so that the deaerated state can be maintained when the article containing portion 2 is deaerated.

Also, although it is not shown, the invention may also be configured so that the article containing portion 2 can be easily deaerated by disposing a check valve, which can allow air flow from the article containing portion 2 to the outside of the bag 1 for containing an article but cuts off air flow in the opposite direction, at a side edge or the front surface or back surface.

Figure 4:
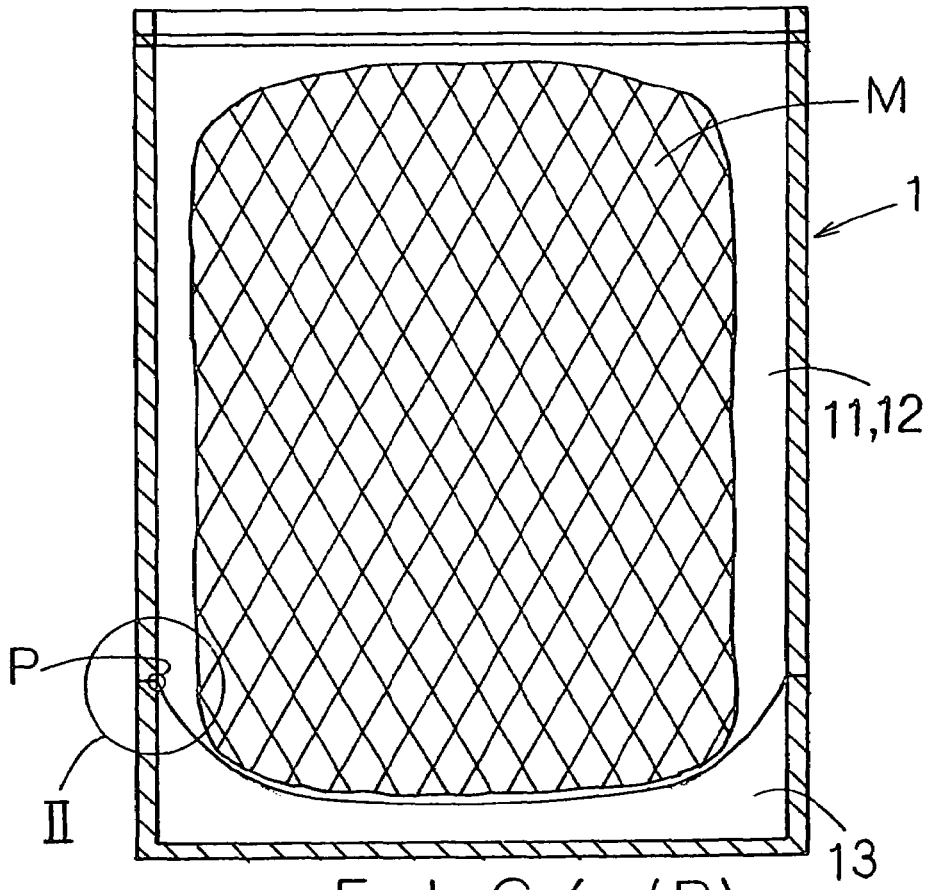
FIG. 4(A) is a plan view showing a state where an article is being contained in an article containing portion of the bag for containing an article of the present example, and (B) is an enlarged view of a portion II of (A).
Figure 4:
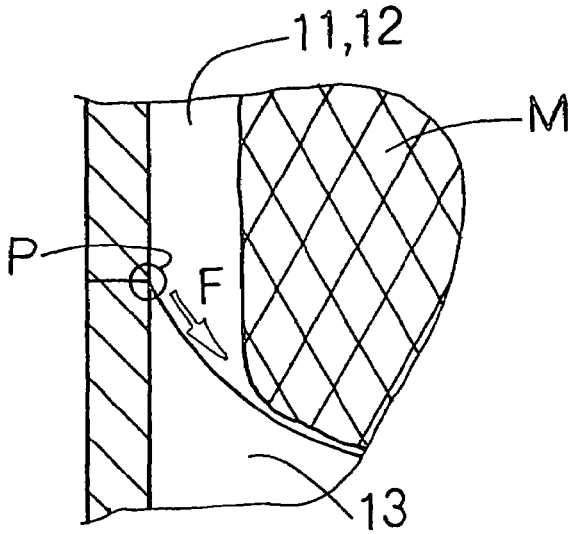

As shown in FIG. 4, the bag 1 for containing an article formed in this manner is such that the chuck 31 of the open portion 3 is opened, the article M is disposed in the article containing portion 2 via the open portion 3 and the bag is compressed or the nozzle of a vacuum is inserted in the half-opened open portion 3 and air present in the article containing portion 2 is removed to the outside of the bag 1 for containing an article. Then, by closing the chuck 31 of the open portion 3, the deaerated state of the article containing portion 2 can be maintained. Thus, in a case where the article M is an article such as bedding or clothing whose volume is large because it includes air, the air included in the article M can be removed so that the bag can be made compact, which is convenient when the bag 1 for containing an article is stored in a storage area or the like.

As can be seen in FIG. 3, a conventionally used laminate sheet of a polypropylene 11*pp*, 12*pp* or polyethylene film 11*pe*, 12*pe* and a biaxially drawn nylon film 11*n*, 12*n* is used for the front sheet 11 and the rear sheet 12 in the bag 1 for containing an article of the present example.

As can be seen in FIG. 3, a laminate sheet of polyethylene film 13*pe* and an inextensible nylon film 13*n* is used for the bottom sheet 13. It should be noted that the bottom sheet 13 is a co-extrusion film that is formed by simultaneously extruding the raw resins of each film at the time the films are manufactured.

The laminate sheet using the inextensible nylon film 13*n* in this manner is not easy to stretch, in comparison to the conventional laminate sheet using the biaxially drawn nylon film, because drawing has not been administered thereto.

Here, a test was conducted where test pieces A and B were respectively cut out from the front sheet 11 or the rear sheet 12 and the bottom sheet 13 in the bag 1 for containing an article of the present example and the strengths of each type were compared. The data therefrom is described below.

In the present test, a laminate film (sheet thickness of 75 micron) comprising a biaxially drawn nylon film (one layer) and a low-density polyethylene film (one layer) was used as the front sheet 11 or the rear sheet 12 and the test piece A was cut out from this.

Also, a laminate film (sheet thickness of 120 micron) comprising low-density polyethylene films (two layers) and a non-oriented nylon film (one layer) sandwiched between these low-density polyethylene films was used as the bottom sheet 13 and the test piece B was cut out from this.

Equal numbers of the test pieces cut out in the vertical direction of the sheets and test pieces cut out in the horizontal direction were prepared and measurement was conducted. The averages of the measurement values of the test pieces were used for the measurement results.

First, tensile strength and tensile ductility were measured. The method of measurement was one based on JISK 7127.

According to the above prescription, a test piece that is a strip with a width of 10 mm to 25 mm and a length of 150 mm or greater, and to which two parallel reference lines 50 mm apart are added to a center portion thereof, is used. This test piece is fixed in grippers of a testing device and pulled at a constant speed in the longitudinal direction until it ruptures, with the load placed on the test piece and the elongation thereof being measured during that time. The pulling speed may be one of 5 mm/min., 50 mm/min., 100 mm/min., 200 mm/min., 300 mm/min. or 500 mm/min.

In the present test, the width of the test piece was 10 mm and the pulling speed was 300 mm/min.

Here, tensile strength refers to a value where the maximum load applied during testing is divided by the cross-sectional area of the test piece prior to the start of testing—i.e., refers to maximum stress during testing. Also, tensile ductility refers to the elongation percentage compared to the test piece prior to the start of testing of the distance between the reference lines at the time the test piece ruptures.

As for the measurement results in the present test, with respect to the tensile strength, test piece A was 51 MPa and test piece B was 36 MPa. Also, with respect to tensile ductility, test piece A was 150% and test piece B was 595%.

Next, tearing strength was measured. The measurement method was one based on JISK 7128. Tearing strength refers to a value where the force necessary to tear a test piece, in which a cut line has been placed, at a constant speed is divided by the sheet width.

As for the measurement results in the present test, test piece A was 79 N/mm and test piece B was 90 N/mm.

Here, when the measurement results of the test piece B were relatively evaluated with respect to those of test pieces A, B was about 70% in regard to tensile strength, which was inferior, but was about 400% in regard to tensile ductility, which was extremely large. Also, in regard to tearing strength, test piece B was about 110%, which was slightly large.

The above results indicate that test piece B required more time than test piece A before it was stretched until it ruptured. Thus, although conventionally there was the problem that a force F generated by suddenly swinging or lifting up the bag 1 for containing an article was suddenly applied with respect to contact points P at which the front sheet 11, the rear sheet 12 and the bottom sheet 13 shown in FIG. 4 are adhered, whereby the bottom sheet 13 ended up tearing, in a case where the force F is only momentarily applied in this manner, it does not lead to rupturing because the force F weakens while the sheet stretches even in a case where the peak value of the force F has exceeded the tensile strength. However, in a case where the bottom sheet 13 is of the same material as the front sheet 11 and the rear sheet 12, the sheet ends up reaching its maximum elongation in a short period of time and, as a result, the potential for the sheet to rupture is high.

Due to the above, a bag 1 for containing an article that is harder to split when the laminate sheet using the inextensible nylon film 13*n* is used as the bottom sheet 13 can be formed.

Conventionally, laminate sheets using inextensible nylon film as described above have come to be widely used in packages resulting from vacuum packs relating to food utilizing the film's property of being easy to stretch. However, until now, there has been no example of using inextensible nylon film 13*n* for the bottom sheet 13 of the bag 1 for containing an article, as in the invention of the present application.

Here, as shown in FIG. 4(A), when the article M is disposed in the article containing portion 2 and disposed so that the bottom portion of the bag 1 for containing an article moves downward, the weight of the article M is applied to the bottom sheet 13, but because the bottom sheet 13 and the front sheet 11 or the rear sheet 12 are adhered together their respective positional relationship does not change. Thus, as shown in FIG. 4(B), a force F in the direction represented by the arrow is applied to the bottom sheet 13.

Figure 5A:
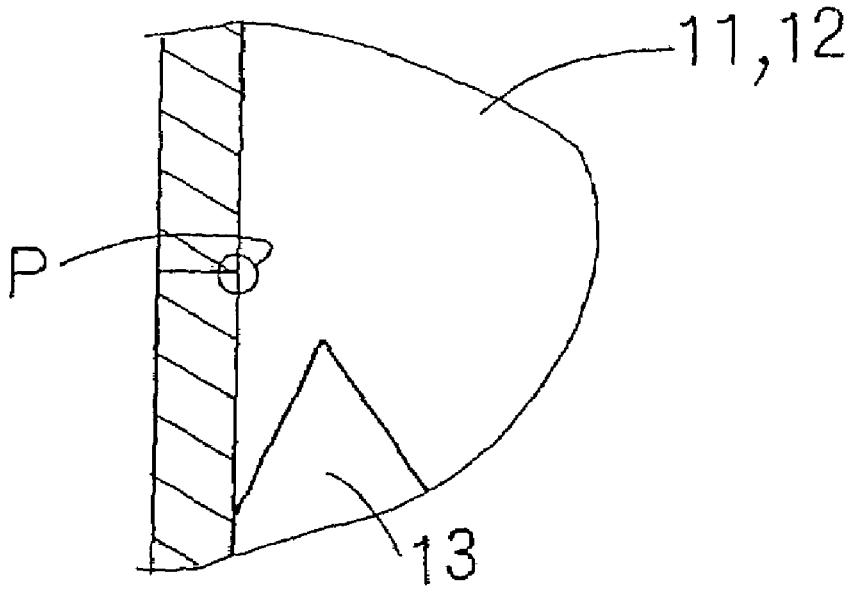
FIG5(A) PRIOR ART
FIG. 5(A) is a main parts enlarged diagram showing a state where a bottom sheet of a conventional article containing bag has ruptured, and (B) is a main parts enlarged diagram showing a state where a bottom sheet of the bag for containing an article of the present example is stretched.
Figure 5:
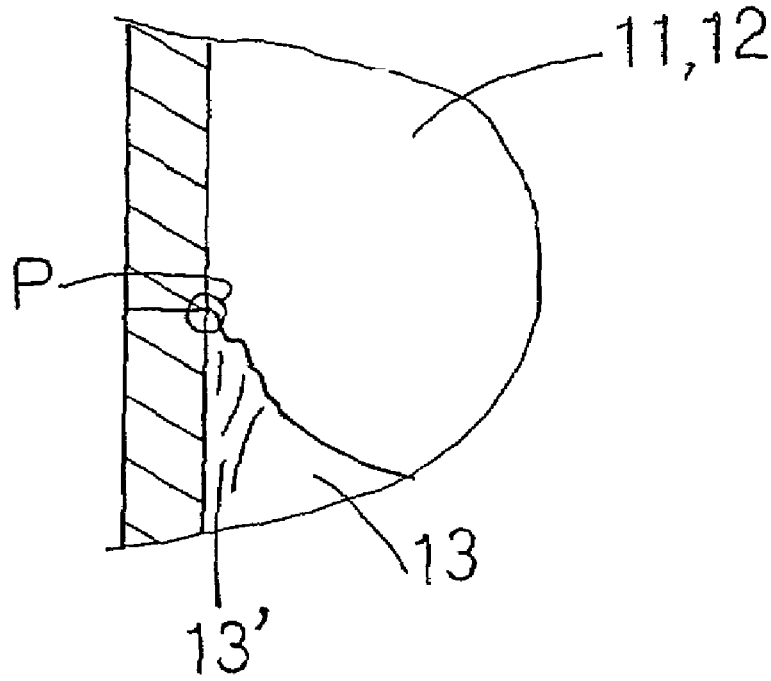

In a case where, as conventionally, a laminate sheet of a polypropylene or polyethylene film and a biaxially drawn nylon film that is the same as that of the front sheet 11 and the rear sheet 12 is used as the bottom sheet 13, there are cases where the bottom sheet 13 is not able to withstand the weight of the article M at the contact points P and is torn as shown in FIG. 5(A). When this happens, the bag 1 for containing an article can no longer be maintained in a state where the article containing portion 2 is deaerated and can no longer fulfill its function as a deaerated bag.

In contrast, in the bag 1 for containing an article pertaining to the invention of the present application, because a laminate sheet using inextensible nylon film 13*n* as described above is used for the bottom sheet 13, a portion 13' in the vicinity of the contact points P in the bottom sheet 13 stretches as shown in FIG. 5(B), so that conventional tearing at the contact points P is prevented and the bag 1 for containing an article can maintain its function as a deaerated bag.

Here, as indicated in the experimental results described above, a laminate sheet whose tensile ductility was about 600% was used in the bottom sheet 13 of the present example, but the tensile ductility of the laminate sheet in the invention of the present application is not limited thereto. It should be noted that the preferable range of tensile ductility during implementation is 400 to 800%.

Here, an experiment was conducted where the bag 1 for containing an article pertaining to the invention of the present application (test piece of the present application) was manufactured and in which the strength thereof was compared to that of conventional bags for containing an article (comparison targets). The data therefrom is described below.

A laminate sheet (sheet thickness of 75 micron) comprising a biaxially drawn nylon film (one layer) and a low-density polyethylene film (one layer) was used for the front sheets 11 and the rear sheets 12 as test piece of the present application and for the comparison targets.

Additionally, a laminate sheet (sheet thickness of 100 micron) comprising low-density polyethylene films 13*pe* (two layers) and an inextensible nylon film 13*n* (one layer) sandwiched between these low-density polyethylene films 13*pe* was used as bottom sheet 13 of the test piece of the present application.

Also, a laminate sheet (sheet thickness of 95 micron) in which a polypropylene film (one layer), a biaxially drawn nylon film (one layer) and a low-density polyethylene film (one layer) were successively laminated was used as the bottom sheet 13 pertaining to a comparison target (1), and a laminate film (sheet thickness of 95 micron) comprising low-density polyethylene films (two layers) and a biaxially drawn nylon film (one layer) sandwiched between these low-density polyethylene films was used as the bottom sheet pertaining to a comparison target (2).

Bags for containing an article were manufactured using the above-described sheets and the following experiment was conducted.

First, the tensile strength between the front sheet 11 and the rear sheet 12 and the bottom sheet 13 was measured. The measurement method was one based on the "Bag Heat Seal Strength Test" prescribed in JISZ 0238. In the bag 1 for containing an article, the front sheet 11 and the rear sheet 12 were pulled upward and the bottom sheet 13 was pulled downward with respect to the contact points P shown in FIG. 4 at a relative moving speed of 300 mm/min., and the load when the sheets ruptured was measured.

As a result, whereas the breaking load (average of two experiments) of the comparison target (1) was 42 N and the breaking load of the comparison target (2) was 51 N, rupturing did not occur with the test piece of the present application even when a load of 162 N was applied, and it was confirmed that the strength of the bottom sheet 13 was far greater in comparison to the conventional laminate sheets. Also, as for the state after the experiment, in the comparison targets, as shown in FIG. 5(A), the bottom sheet 13 ruptured along the heat seals of the side edges starting at the contact points P. In contrast, in the test piece of the present application, as shown in FIG. 5(B), the bottom sheet 13 in the vicinity of the contact points P was stretched.

Also, an experiment where consideration was given to actual state of use was conducted in the following manner.

First, the article containing portions 2 of the test piece of the present application and the comparison targets were filled with air and then the chucks 31 of the open portion 3 were tightly closed. When weight was added in this state so that the bags were compressed, the bottom sheets 13 in each of the comparison targets ruptured starting at the contact points P and the bags split similar to the above-described experiment, but the bottom sheet 13 in the test piece of the present application only stretched and the bag did not split.

Next, when the article containing portions 2 were suddenly lifted up with the bottom sheet 13 downward in a state where bedding was disposed in the article containing portions 2, the bottom sheets 13 in each of the comparison targets ruptured starting at the contact points P and the bags split similar to the above, but the bottom sheet 13 in the test piece of the present application only stretched and the bag did not split.

From the results of the above-described experiments, it was confirmed that the bag 1 for containing an article pertaining to the invention of the present application had sufficiently great strength in comparison to the conventional bags for containing an article.

The bag for containing an article pertaining to the invention of the present application is not limited to the example described above and can be carried and implemented. For example, in regard to the bottom sheet 13, although a sheet folded in two was used in the present example, a sheet folded in three or more may also be used. Also, although an inextensible nylon film 13*n* was used in the present example as the film used for the bottom sheet 13, it suffices as long as the sheet is one that can form a laminate sheet using films having excellent extensibility and tearing resistance in comparison to the laminate sheets of the front sheet 11 and the rear sheet 12, and an inextensible film of polyethylene or polypropylene may also be used.

The invention may also be configured using the same laminate sheet of the polyethylene film 13*pe* and the inextensible nylon film 13*n* as the bottom sheet 13 for either of the front sheet 11 or the rear sheet 12 together with the bottom sheet.

The invention claimed is:

1. A deaeratable bag for containing an article comprising:

a front sheet (11), a rear sheet (12) and a bottom sheet (13) disposed at a lower portion of the front sheet (11) and the rear sheet (12), which are resin sheets having flexibility, with an article containing portion (2) being formed between these sheets (11, 12, 13), wherein the article containing portion (2) of the deaeratable bag is adapted to deaerate and store an article (M) that is large in volume because the article includes air by compressing the article including the air, and when the article (M) is disposed in the article containing portion (2) and disposed so that the bottom portion of the bag move downward, and a weight of the article (M) is supplied to the bottom sheet (13), wherein the front sheet (11) includes a bottom edge (11*d*) positioned below and left and right side edges (11*b*, 11*c*) that extend upward from both left and right ends of the bottom edge (11*d*), wherein the rear sheet (12) includes a bottom edge (12*d*) positioned below and left and right side edges (12*b*, 12*c*) that extend upward from both left and right ends of the bottom edge (12*d*), wherein the bottom sheet (13) includes a front bottom surface (13*x*) and a rear bottom surface (13*y*) that are partitioned across at least one folding line (13*a*), wherein the front bottom surface (13*x*) includes the folding line (13*a*), a front bottom edge (13*f*) positioned below the folding line (13*a*), and a left front side edge (13*b*) and a right front side edge (13*d*) that join both respective left and right ends of the folding line (13*a*) and the front bottom edge (13*f*), wherein the rear bottom surface (13*y*) includes the folding line (13*a*), a rear bottom edge (13*g*) positioned below the folding line (13*a*), and a left rear side edge (13*c*) and a right rear side edge (13*e*) that join both respective left and right ends of the folding line (13*a*) and the rear bottom edge (13*g*), wherein the folding line (13*a*) is disposed between the front sheet (11) and the rear sheet (12), wherein the bottom edge (11*d*) of the front sheet (11) and the front bottom edge (13*f*) of the bottom sheet (13) are adhered together, wherein the bottom edge (12*d*) of the rear sheet (12) and the rear bottom edge (13*g*) of the bottom sheet (13) are adhered together, wherein the left and right side edges (11*b*, 11*c*) of the front sheet (11) and the left and right side edges (12*b*, 12*c*) of the rear sheet (12) are respectively adhered together above the folding line (13*a*), wherein a bag body (1) including therein an article containing portion (2) is formed by the bottom edge (11*d*) of the front sheet (11) and the front bottom edge (13*f*) of the bottom sheet (13) being adhered together and by the bottom edge (12*d*) of the rear sheet (12) and the rear bottom edge (13*g*) of the bottom sheet (13) being adhered together, wherein an upper edge (11*a*) of the front sheet (110 and an upper edge (12*a*) of the rear sheet (12) are not adhered together, but an open portion (3) is formed so that the article (M) can be placed in and taken from the article containing portion (2), and a chuck (31) is attached to the opening portion (3) so that a deaerated state can be maintained when the article containing portion (2) is deaerated, wherein the bottom sheet (13) is located opposite to the opening portion (3), wherein a laminate sheet of film selected from a group consisting a polypropylene (11*pp*, 12*pp*) film and a polyethylene film (11*pe*, 12*pe*), and a biaxially drawn nylon film (11*n*, 12*n*) are used for the front sheet (11) and the rear sheet (12), wherein the bottom sheet (13) is a co-extrusion film including the nylon film (13*n*) to which drawing has not been administered, and the polyethylene film (13*pe*) laminated together, the polyethylene film (13*pe*) being disposed on at least one of a surface side and an undersurface side of the nylon film (13*n*), and wherein the bottom sheet (13) formed of the co-extrusion film, including the nylon film (13*n*) to which drawing has not been administered and the polyethylene film (13*pe*) laminated together, is easier to stretch in comparison to the laminate sheet of the biaxially drawn nylon film used for the front sheet (11) and the rear sheet (12), and wherein the laminate sheet of the bottom sheet (13) is easier to stretch, in comparison to the laminate sheet of the biaxially drawn nylon film used for the front sheet (11) and the rear sheet (12), and the extensibility and tearing resistance of the bottom sheet (13) are higher than the extensibility and tearing resistance of the front sheet (11) and the rear sheet (12), the bottom sheet (13) having a tensile ductility of 400% to 800%.

2. The deaeratable bag for containing an article according to claim 1, wherein the left front side edge (13*b*) of the front bottom surface and the left rear side edge (13*c*) of the rear bottom surface in the bottom sheet (13) are adhered together, and wherein the right front side edge (13*d*) of the front bottom surface and the right rear side edge (13*e*) of the rear bottom surface are adhered together.

3. The deaeratable bag for containing an article according to claim 1, wherein the bottom sheet (13) is a co-extrusion film including the nylon film (13*n*) to which drawing has not been administered, and the polyethylene film (13*pe*) laminated together, the polyethylene film (13*pe*) being disposed on at least one of a surface side and an undersurface side of the nylon film (13*n*), wherein the bottom sheet (13) formed of the co-extrusion film, including the nylon film (13*n*) to which drawing has not been administered and the polyethylene film laminated together, is easier to stretch in comparison to the laminate sheet of the biaxially drawn nylon film used for the front sheet (11) and the rear sheet (12), wherein the left and right side edges (11*b*, 11*c*) of the front sheet (11) are adhered to the left and right side edges (12*b*, 12*c*) of the rear sheet (12) in a range (1*a*) where the bottom sheet (13) is not present between the front sheet (11) and the rear sheet (12), and the left and right side edges (11*b*, 11*c*) of the front sheet (11) are adhered to the left and right front side edges (13*b*, 13*d*) of the bottom sheet (13) and the left and right side edges (12*b*, 12*c*) of the rear sheet (12) are adhered to the left and right rear side edges (13*c*, 13*e*) of the bottom sheet (13) in a range (1*b*) where the bottom sheet (13) is present, while the front and rear edges (13*b*, 13*c*) on the left side of the bottom sheet (13) are not adhered as well as the front and rear edges (13*d*, 13*e*) on the right side of the bottom sheet (13), and wherein even a force F generated by a sudden swing or lifting of the bag (1) is applied with respect to contact points (P) at which the front sheet (11), the rear sheet (12) and the bottom sheet (13) are adhered, the portion (13') in the vicinity of the contact points (P) in the bottom sheet (13) stretches, whereby tearing at the contact points (P).

4. The deaeratable bag for containing an article according to claim 1, wherein a laminate film comprising two-layer low-density polyethylene films (13*pe*) and one-layer nylon film (13*n*), to which drawing has not been administered, is used as the bottom sheet (13), and wherein the one-layer nylon film (13*n*) is sandwiched between the low-density polyethylene films (13*pe*).

* * * * *